US009328623B2

(12) United States Patent
McMahan et al.

(10) Patent No.: US 9,328,623 B2
(45) Date of Patent: May 3, 2016

(54) TURBINE SYSTEM

(75) Inventors: Kevin Weston McMahan, Greer, SC (US); Daniel Jackson Dillard, Greenville, SC (US)

(73) Assignee: General Electric Company, Schenectady, NY (US)

( * ) Notice: Subject to any disclaimer, the term of this patent is extended or adjusted under 35 U.S.C. 154(b) by 1210 days.

(21) Appl. No.: 13/253,298

(22) Filed: Oct. 5, 2011

(65) Prior Publication Data

US 2013/0086914 A1 Apr. 11, 2013

(51) Int. Cl.
*F01D 5/18* (2006.01)
*F01D 9/02* (2006.01)

(52) U.S. Cl.
CPC ..... *F01D 9/023* (2013.01); *F01D 5/186* (2013.01); *F01D 5/187* (2013.01); *F05D 2300/6033* (2013.01)

(58) Field of Classification Search
CPC . F05D 2300/6033; F01D 5/186; F01D 5/187; F01D 9/065; F01D 11/08; F01D 11/24
USPC ..... 415/115, 116, 173.1, 173.2; 416/96 R, 416/97 R
See application file for complete search history.

(56) References Cited

U.S. PATENT DOCUMENTS 5,077,967 A * 1/1992 Widener et al. ..... 60/772
5,592,820 A * 1/1997 Alary et al. ..... 60/751
5,839,283 A * 11/1998 Dobbeling ..... 60/737
6,202,420 B1 * 3/2001 Zarzalis et al. ..... 60/737
6,230,483 B1 * 5/2001 Sakon ..... F01D 5/18 415/114
6,264,426 B1 * 7/2001 Fukuno ..... F01D 5/187 415/115
6,315,518 B1 * 11/2001 Uematsu ..... F01D 5/186 415/115
6,390,769 B1 * 5/2002 Burdgick ..... F01D 5/187 415/116
6,441,341 B1 * 8/2002 Steibel ..... B23K 26/1476 219/121.66
6,471,475 B1 * 10/2002 Sasu et al. ..... 415/211.2
6,526,358 B1 * 2/2003 Mathews, Jr. ..... G01M 3/26 702/45
6,528,190 B1 * 3/2003 Campbell et al. ..... 428/701
6,564,555 B2 * 5/2003 Rice et al. ..... 60/746
7,117,983 B2 * 10/2006 Good ..... F01D 9/04 188/380
7,181,914 B2 * 2/2007 Pidcock et al. ..... 60/751
7,198,458 B2 * 4/2007 Thompson ..... F01D 5/147 415/115
7,255,535 B2 * 8/2007 Albrecht ..... F01D 5/147 416/229 R (Continued)

FOREIGN PATENT DOCUMENTS

EP 1903184 A2 3/2008

OTHER PUBLICATIONS

Unofficial English Translation of Chinese Office Action issued in connection with corresponding CN Application No. 201210272340.0 on Feb. 4, 2015.

*Primary Examiner* — Arun Goyal
(74) *Attorney, Agent, or Firm* — Dority & Manning, P.A.

(57) ABSTRACT

A turbine system is disclosed. The turbine system includes a transition duct having an inlet, an outlet, and a passage extending between the inlet and the outlet and defining a longitudinal axis, a radial axis, and a tangential axis. The outlet of the transition duct is offset from the inlet along the longitudinal axis and the tangential axis. The turbine system further includes a turbine section connected to the transition duct. The turbine section includes a plurality of shroud blocks at least partially defining a hot gas path, a plurality of buckets at least partially disposed in the hot gas path, and a plurality of nozzles at least partially disposed in the hot gas path. At least one of a shroud block, a bucket, or a nozzle includes means for withstanding high temperatures.

9 Claims, 5 Drawing Sheets

(56) References Cited

U.S. PATENT DOCUMENTS 7,721,547 B2 * 5/2010 Bancalari et al. ..... 60/752
8,807,944 B2 * 8/2014 Itzel ..... F01D 5/18 416/96 A
2002/0076541 A1 * 6/2002 Jarmon et al. ..... 428/312.6
2003/0046939 A1 * 3/2003 Hyakutake et al. ..... 60/782
2003/0049126 A1 * 3/2003 Uematsu et al. ..... 416/97 R
2004/0047726 A1 * 3/2004 Morrison ..... F01D 9/04 415/116
2004/0202886 A1 * 10/2004 Subramanian ..... 428/632
2005/0158171 A1 * 7/2005 Carper et al. ..... 415/200
2006/0101827 A1 * 5/2006 Ryan ..... F23R 3/007 60/796
2007/0048144 A1 * 3/2007 Morrison ..... C04B 41/009 416/224
2007/0180827 A1 * 8/2007 Dawson et al. ..... 60/752
2007/0237647 A1 * 10/2007 Bulgrin ..... F01D 25/12 416/248
2009/0238684 A1 * 9/2009 Morrison et al. ..... 415/178
2010/0037617 A1 * 2/2010 Charron et al. ..... 60/752
2010/0037618 A1 * 2/2010 Charron et al. ..... 60/752
2010/0037619 A1 2/2010 Charron
2010/0115953 A1 * 5/2010 Davis et al. ..... 60/737
2013/0017094 A1 * 1/2013 Coupe ..... B29C 70/24 416/230

* cited by examiner

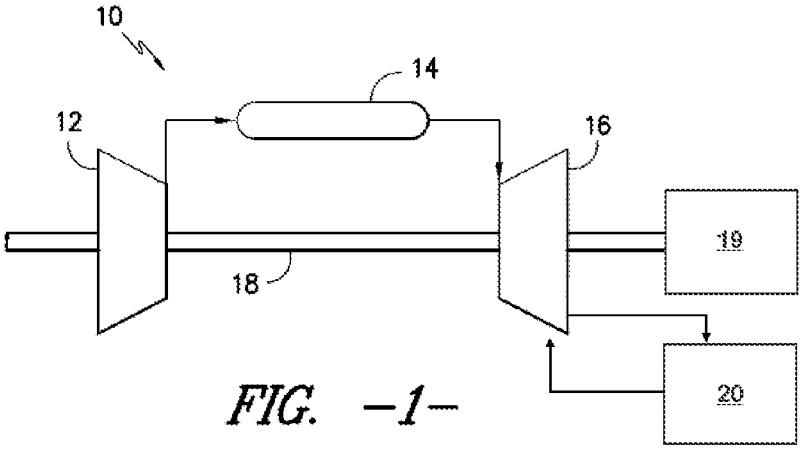
FIG. –1–
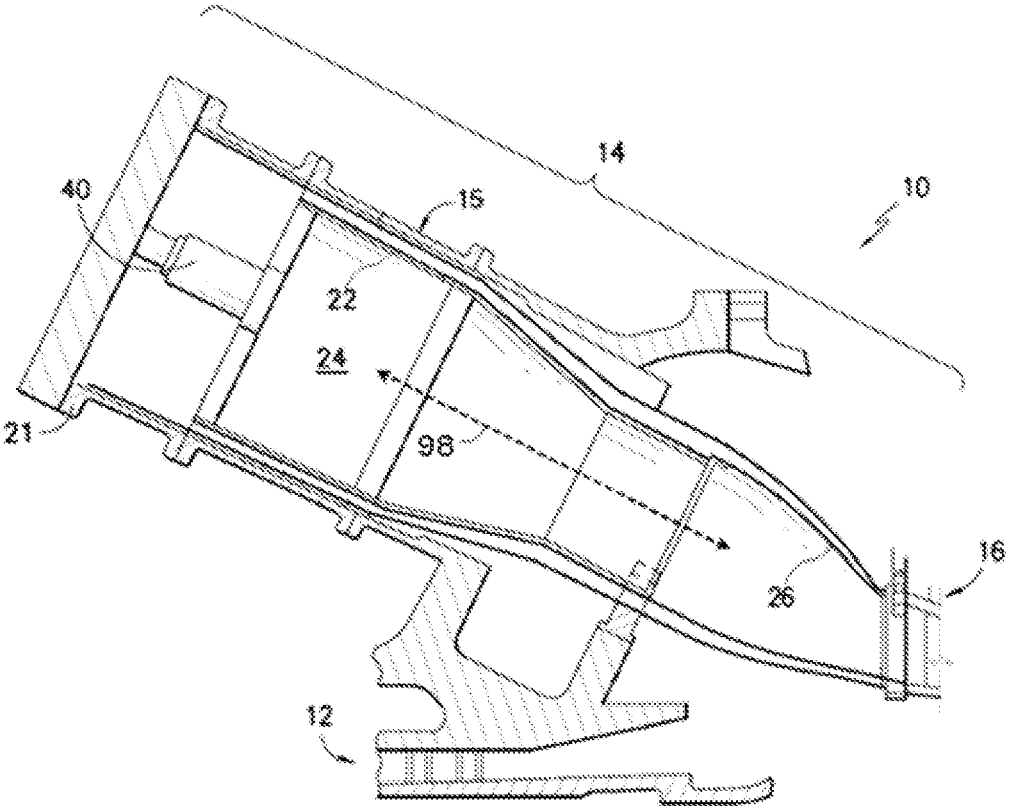
FIG. –2–

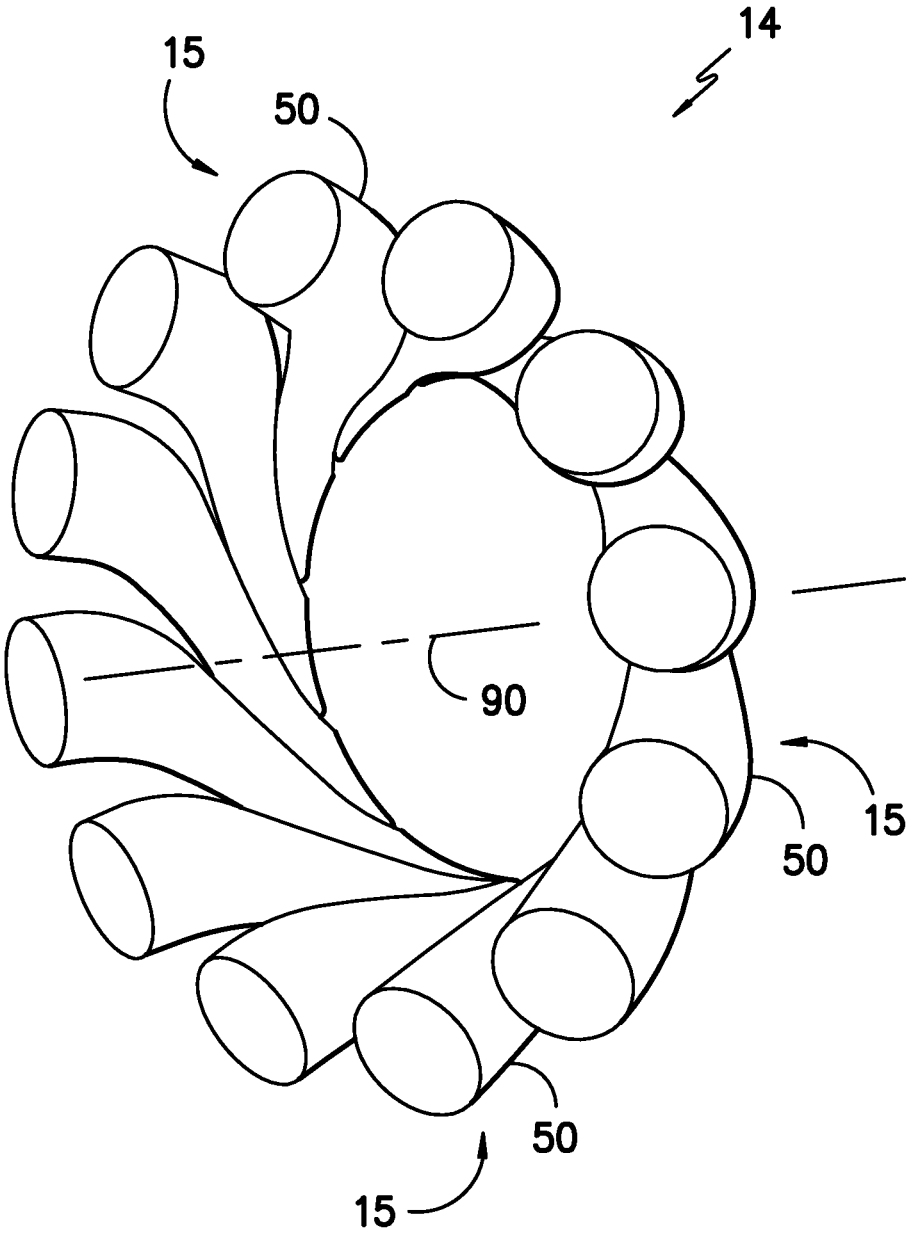
FIG. –3–

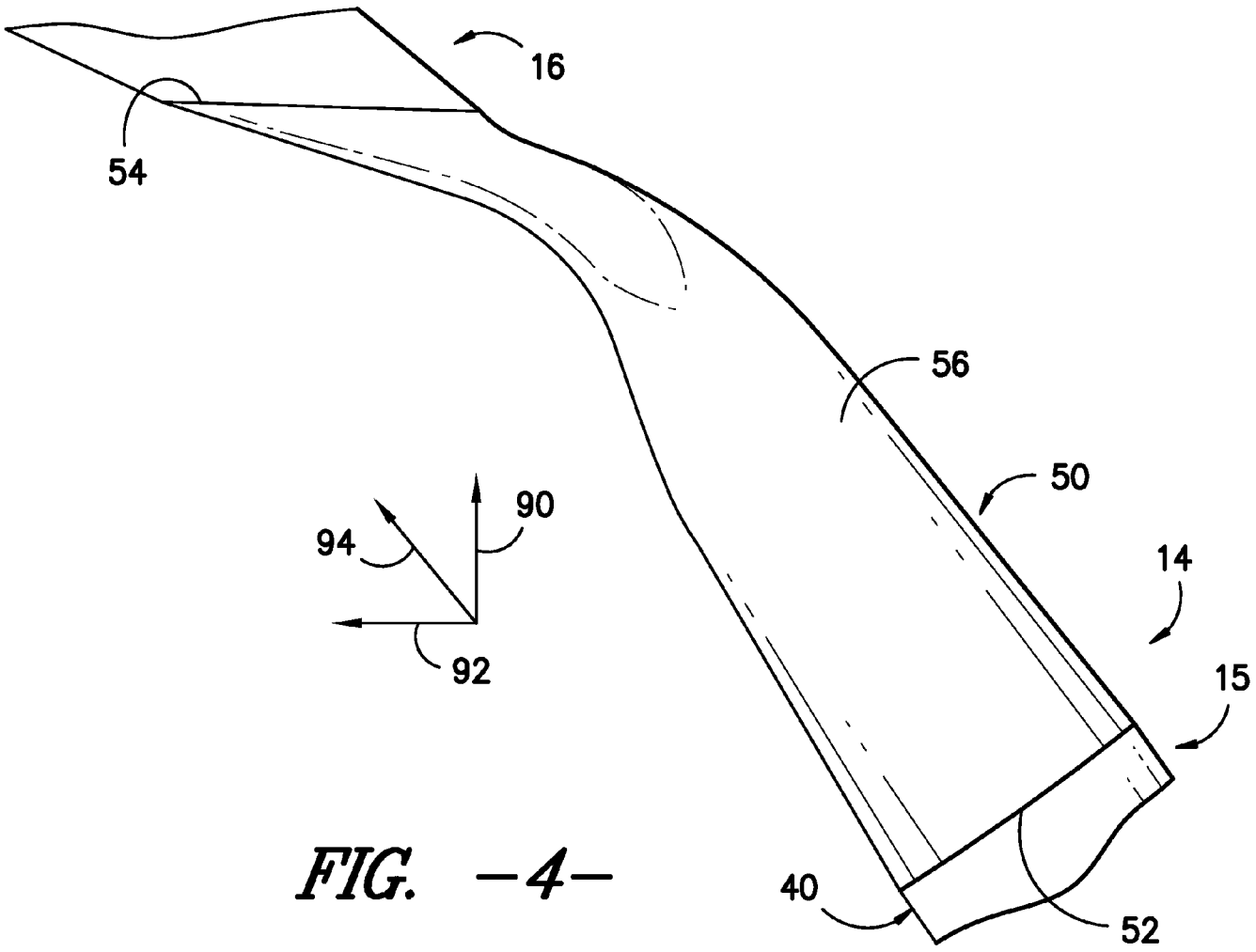
FIG. —4—

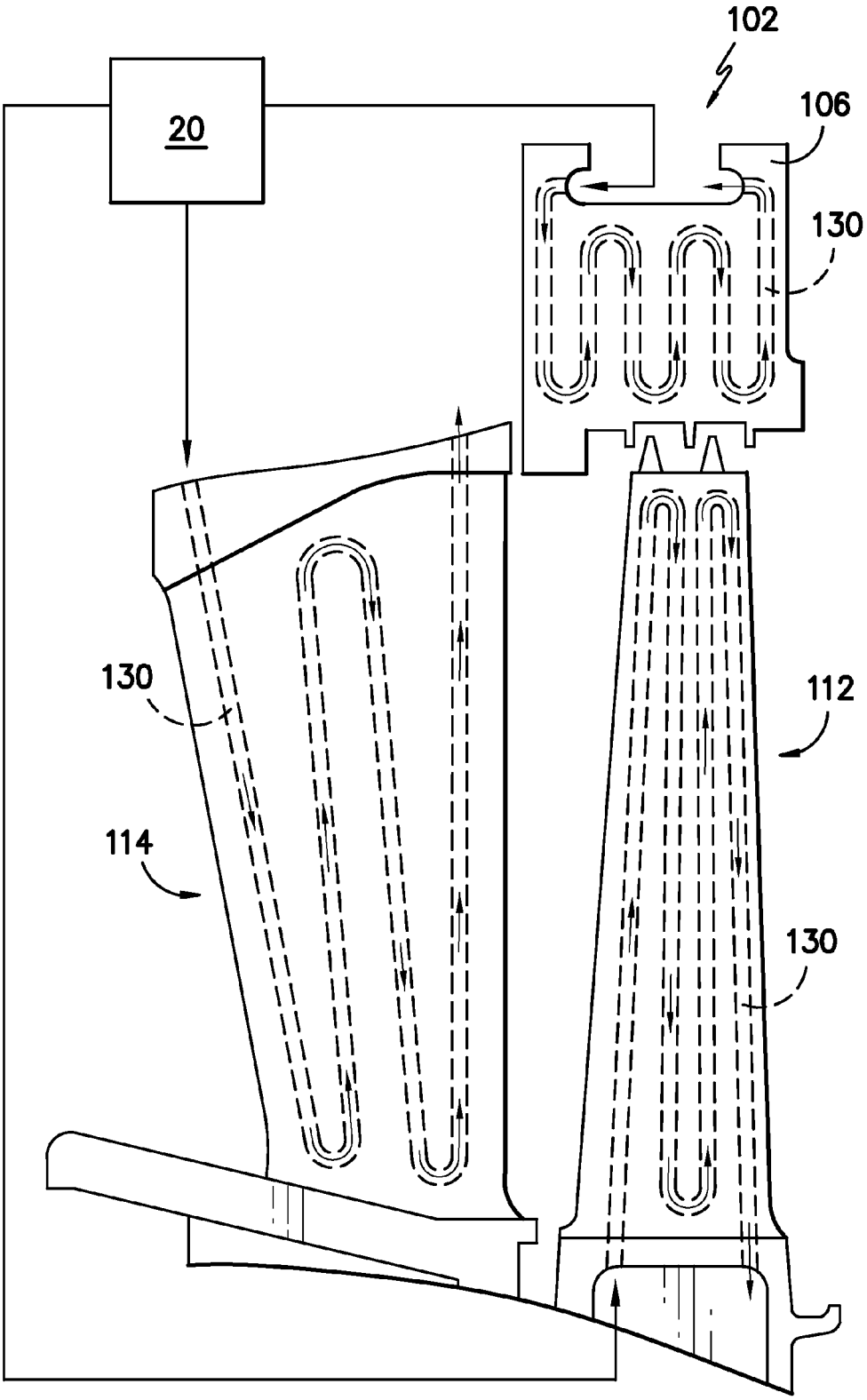
FIG. –6–

TURBINE SYSTEM

This invention was made with government support under contract number DE-FC26-05NT42643 awarded by the Department of Energy. The government has certain rights in the invention.

FIELD OF THE INVENTION

The subject matter disclosed herein relates generally to turbine systems, and more particularly to transition ducts and turbine sections of turbine systems.

BACKGROUND OF THE INVENTION

Turbine systems are widely utilized in fields such as power generation. For example, a conventional gas turbine system includes a compressor section, a combustor section, and at least one turbine section. The compressor section is configured to compress air as the air flows through the compressor section. The air is then flowed from the compressor section to the combustor section, where it is mixed with fuel and combusted, generating a hot gas flow. The hot gas flow is provided to the turbine section, which utilizes the hot gas flow by extracting energy from it to power the compressor, an electrical generator, and other various loads.

The combustor sections of turbine systems generally include tubes or ducts for flowing the combusted hot gas therethrough to the turbine section or sections. Recently, combustor sections have been introduced which include tubes or ducts that shift the flow of the hot gas. For example, ducts for combustor sections have been introduced that, while flowing the hot gas longitudinally therethrough, additionally shift the flow radially or tangentially such that the flow has various angular components. These designs have various advantages, including eliminating first stage nozzles from the turbine sections. The first stage nozzles were previously provided to shift the hot gas flow, and may not be required due to the design of these ducts. The elimination of first stage nozzles may eliminate associated pressure drops and increase the efficiency and power output of the turbine system.

However, such designs of combustor sections have various disadvantages. For example, the temperature of the hot gas flowed into and through the turbine system is increased due to the elimination of the first stage nozzles. This is because leakage of cooling flows from the first stage nozzles is eliminated. However, other components of the turbine section, such as various other stages of nozzles, the various stages of buckets, and the various stages of shrouds, are subjected to these increased temperatures. Without sufficient cooling, these components may be damaged or may fail during operation of the turbine system.

Accordingly, an improved turbine system would be desired in the art. Specifically, a turbine system that includes improved apparatus for allowing the various components of the turbine section to withstand higher temperatures and for use with a transition duct would be advantageous.

BRIEF DESCRIPTION OF THE INVENTION

Aspects and advantages of the invention will be set forth in part in the following description, or may be obvious from the description, or may be learned through practice of the invention.

In one embodiment, a turbine system is disclosed. The turbine system includes a transition duct having an inlet, an outlet, and a passage extending between the inlet and the outlet and defining a longitudinal axis, a radial axis, and a tangential axis. The outlet of the transition duct is offset from the inlet along the longitudinal axis and the tangential axis. The turbine system further includes a turbine section connected to the transition duct. The turbine section includes a plurality of shroud blocks at least partially defining a hot gas path, a plurality of buckets at least partially disposed in the hot gas path, and a plurality of nozzles at least partially disposed in the hot gas path. At least one of a shroud block, a bucket, or a nozzle includes means for withstanding high temperatures.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 1 is a schematic view of a gas turbine system according to one embodiment of the present disclosure;

FIG. 2 is a cross-sectional view of several portions of a gas turbine system according to one embodiment of the present disclosure;

FIG. 3 is a perspective view of an annular array of transition ducts according to one embodiment of the present disclosure;

FIG. 4 is a top view of a transition duct according to one embodiment of the present disclosure;

FIG. 6 is a close-up cross-sectional view of various components of a turbine section of a gas turbine system according to one embodiment of the present disclosure.

DETAILED DESCRIPTION OF THE INVENTION

Figure 5:
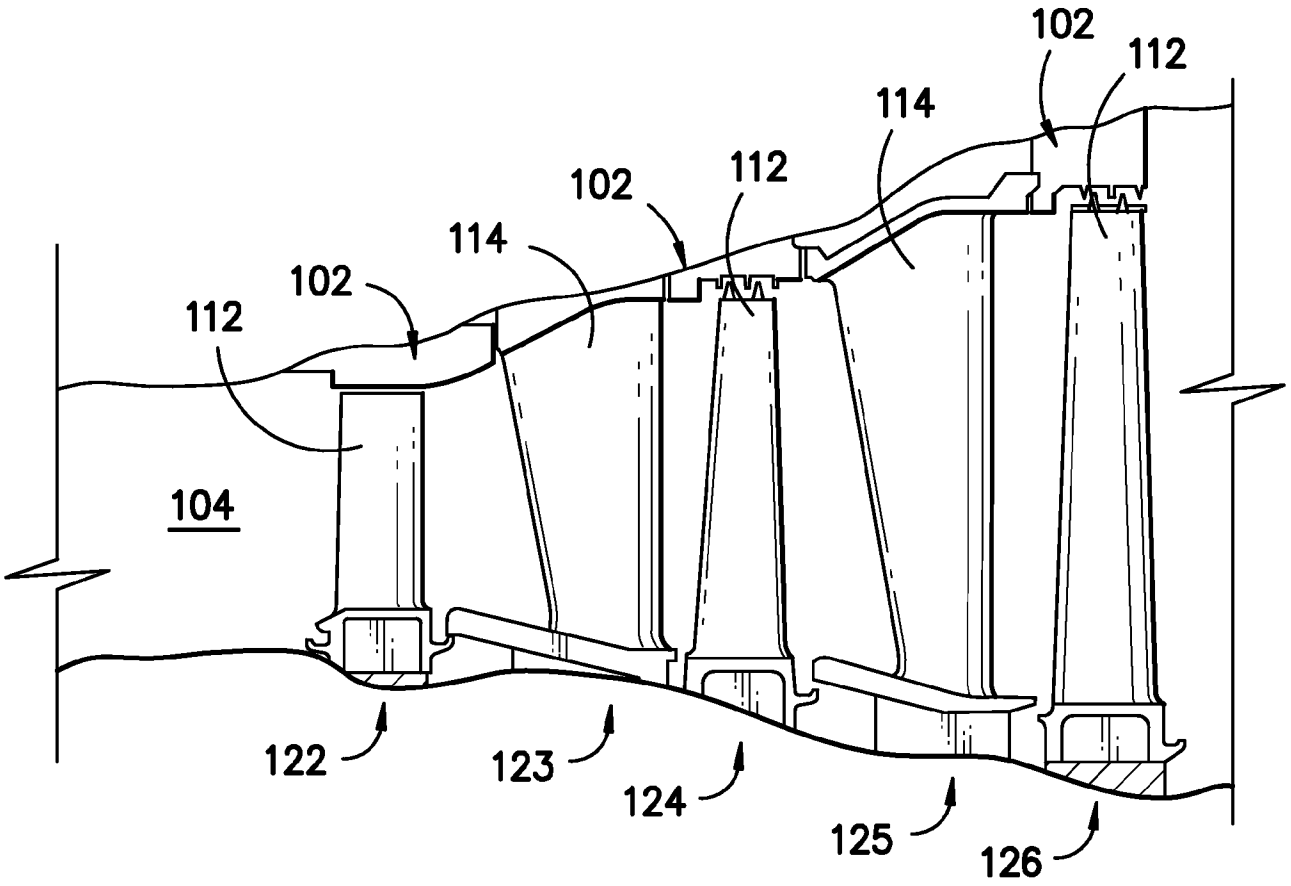
FIG. 5 is a cross-sectional view of a turbine section of a gas turbine system according to one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a schematic diagram of a gas turbine system 10. It should be understood that the turbine system 10 of the present disclosure need not be a gas turbine system 10, but rather may be any suitable turbine system 10, such as a steam turbine system or other suitable system. The gas turbine system 10 may include a compressor section 12, a combustor section 14 which may include a plurality of combustors 15 as discussed below, and a turbine section 16. The compressor section 12 and turbine section 16 may be coupled by a shaft 18. The shaft 18 may be a single shaft or a plurality of shaft segments coupled together to form shaft 18. The shaft 18 may further be coupled to a generator 19 or other suitable energy storage device, or may be connected directly to, for example, an electrical grid. Exhaust gases from the system 10 may be exhausted into the atmosphere, flowed to a steam turbine or other suitable system, or recycled through a heat recovery steam generator 20, as shown.

Referring to FIG. 2, a simplified drawing of several portions of a gas turbine system 10 is illustrated. The gas turbine system 10 as shown in FIG. 2 comprises a compressor section 12 for pressurizing a working fluid, discussed below, that is flowing through the system 10. Pressurized working fluid discharged from the compressor section 12 flows into a combustor section 14, which may include a plurality of combustors 15 (only one of which is illustrated in FIG. 2) disposed in an annular array about an axis of the system 10. The working fluid entering the combustor section 14 is mixed with fuel, such as natural gas or another suitable liquid or gas, and combusted. Hot gases of combustion flow from each combustor 15 to a turbine section 16 to drive the system 10 and generate power.

A combustor 15 in the gas turbine 10 may include a variety of components for mixing and combusting the working fluid and fuel. For example, the combustor 15 may include a casing 21, such as a compressor discharge casing 21. A variety of sleeves, which may be axially extending annular sleeves, may be at least partially disposed in the casing 21. The sleeves, as shown in FIG. 2, extend axially along a generally longitudinal axis 98, such that the inlet of a sleeve is axially aligned with the outlet. For example, a combustor liner 22 may generally define a combustion zone 24 therein. Combustion of the working fluid, fuel, and optional oxidizer may generally occur in the combustion zone 24. The resulting hot gases of combustion may flow generally axially along the longitudinal axis 98 downstream through the combustion liner 22 into a transition piece 26, and then flow generally axially along the longitudinal axis 98 through the transition piece 26 and into the turbine section 16.

The combustor 15 may further include a fuel nozzle 40 or a plurality of fuel nozzles 40. Fuel may be supplied to the fuel nozzles 40 by one or more manifolds (not shown). As discussed below, the fuel nozzle 40 or fuel nozzles 40 may supply the fuel and, optionally, working fluid to the combustion zone 24 for combustion.

As shown in FIGS. 3 through 4, a combustor 15 according to the present disclosure may include a transition duct 50. The transition ducts 50 of the present disclosure may be provided in place of various axially extending sleeves of other combustors. For example, a transition duct 50 may replace the axially extending transition piece 26 and, optionally, the combustor liner 22 of a combustor 15. Thus, the transition duct may extend from the fuel nozzles 40, or from the combustor liner 22. As discussed below, the transition duct 50 may provide various advantages over the axially extending combustor liners 22 and transition pieces 26 for flowing working fluid therethrough and to the turbine section 16.

As shown, the plurality of transition ducts 50 may be disposed in an annular array about longitudinal axis 90. Further, each transition duct 50 may extend between a fuel nozzle 40 or plurality of fuel nozzles 40 and the turbine section 16. For example, each transition duct 50 may extend from the fuel nozzles 40 to the turbine section 16. Thus, working fluid may flow generally from the fuel nozzles 40 through the transition duct 50 to the turbine section 16. In some embodiments, the transition ducts 50 may advantageously allow for the elimination of the first stage nozzles in the turbine section, which may eliminate any associated drag and pressure drop and increase the efficiency and output of the system 10.

Each transition duct 50 may have an inlet 52, an outlet 54, and a passage 56 therebetween. The inlet 52 and outlet 54 of a transition duct 50 may have generally circular or oval cross-sections, rectangular cross-sections, triangular cross-sections, or any other suitable polygonal cross-sections. Further, it should be understood that the inlet 52 and outlet 54 of a transition duct 50 need not have similarly shaped cross-sections. For example, in one embodiment, the inlet 52 may have a generally circular cross-section, while the outlet 54 may have a generally rectangular cross-section.

Further, the passage 56 may be generally tapered between the inlet 52 and the outlet 54. For example, in an exemplary embodiment, at least a portion of the passage 56 may be generally conically shaped. Additionally or alternatively, however, the passage 56 or any portion thereof may have a generally rectangular cross-section, triangular cross-section, or any other suitable polygonal cross-section. It should be understood that the cross-sectional shape of the passage 56 may change throughout the passage 56 or any portion thereof as the passage 56 tapers from the relatively larger inlet 52 to the relatively smaller outlet 54.

The outlet 54 of each of the plurality of transition ducts 50 may be offset from the inlet 52 of the respective transition duct 50. The term "offset", as used herein, means spaced from along the identified coordinate direction. The outlet 54 of each of the plurality of transition ducts 50 may be longitudinally offset from the inlet 52 of the respective transition duct 50, such as offset along the longitudinal axis 90.

Additionally, in exemplary embodiments, the outlet 54 of each of the plurality of transition ducts 50 may be tangentially offset from the inlet 52 of the respective transition duct 50, such as offset along a tangential axis 92. Because the outlet 54 of each of the plurality of transition ducts 50 is tangentially offset from the inlet 52 of the respective transition duct 50, the transition ducts 50 may advantageously utilize the tangential component of the flow of working fluid through the transition ducts 50 to eliminate the need for first stage nozzles in the turbine section 16, as discussed below.

Further, in exemplary embodiments, the outlet 54 of each of the plurality of transition ducts 50 may be radially offset from the inlet 52 of the respective transition duct 50, such as offset along a radial axis 94. Because the outlet 54 of each of the plurality of transition ducts 50 is radially offset from the inlet 52 of the respective transition duct 50, the transition ducts 50 may advantageously utilize the radial component of the flow of working fluid through the transition ducts 50 to further eliminate the need for first stage nozzles in the turbine section 16, as discussed below.

It should be understood that the tangential axis 92 and the radial axis 94 are defined individually for each transition duct 50 with respect to the circumference defined by the annular array of transition ducts 50, as shown in FIG. 3, and that the axes 92 and 94 vary for each transition duct 50 about the circumference based on the number of transition ducts 50 disposed in an annular array about the longitudinal axis 90.

As discussed, after hot gases of combustion are flowed through the transition duct 50, they may be flowed from the transition duct 50 into the turbine section 16. As shown in FIGS. 5 and 6, a turbine section 16 according to the present disclosure may include a shroud 102, which may define a hot gas path 104. The shroud 102 may be formed from a plurality of shroud blocks 106. The shroud blocks 106 may be disposed in one or more annular arrays, each of which may define a portion of the hot gas path 104 therein.

The turbine section 16 may further include a plurality of buckets 112 and a plurality of nozzles 114. Each of the plurality of buckets 112 and nozzles 114 may be at least partially disposed in the hot gas path 104. Further, the plurality of buckets 112 and the plurality of nozzles 114 may be disposed in one or more annular arrays, each of which may define a portion of the hot gas path 104.

The turbine section 16 may include a plurality of turbine stages. Each stage may include a plurality of buckets 112 disposed in an annular array and a plurality of nozzles 114 disposed in an annular array. For example, in one embodiment, the turbine section 16 may have three stages, as shown in FIG. 5. For example, a first stage of the turbine section 16 may include a first stage nozzle assembly (not shown) and a first stage buckets assembly 122. The nozzles assembly may include a plurality of nozzles 114 disposed and fixed circumferentially about the shaft 18. The bucket assembly 122 may include a plurality of buckets 112 disposed circumferentially about the shaft 18 and coupled to the shaft 18. In exemplary embodiments wherein the turbine section is coupled to combustor section 14 comprising a plurality of transition ducts 50, however, the first stage nozzle assembly may be eliminated, such that no nozzles are disposed upstream of the first stage bucket assembly 122. Upstream may be defined relative to the flow of hot gases of combustion through the hot gas path 104.

A second stage of the turbine section 16 may include a second stage nozzle assembly 123 and a second stage buckets assembly 124. The nozzles 114 included in the nozzle assembly 123 may be disposed and fixed circumferentially about the shaft 18. The buckets 112 included in the bucket assembly 124 may be disposed circumferentially about the shaft 18 and coupled to the shaft 18. The second stage nozzle assembly 123 is thus positioned between the first stage bucket assembly 122 and second stage bucket assembly 124 along the hot gas path 104. A third stage of the turbine section 16 may include a third stage nozzle assembly 125 and a third stage bucket assembly 126. The nozzles 114 included in the nozzle assembly 125 may be disposed and fixed circumferentially about the shaft 18. The buckets 112 included in the bucket assembly 126 may be disposed circumferentially about the shaft 18 and coupled to the shaft 18. The third stage nozzle assembly 125 is thus positioned between the second stage bucket assembly 124 and third stage bucket assembly 126 along the hot gas path 104.

It should be understood that the turbine section 16 is not limited to three stages, but rather that any number of stages are within the scope and spirit of the present disclosure.

As discussed, the temperature of the hot gases flowing from the combustor section 14 to the turbine section 16 may be increased due to the use of a transition duct 50, and further due to the elimination of the first stage nozzle assembly. Thus, the various components of the turbine section 16 must be able to withstand these increased temperatures. As such, one or more of a shroud block 106, a bucket 112, or a nozzle 114, such as one or more stages thereof, may include means for withstanding high temperatures. Such means may include any suitable materials or cooling apparatus for withstanding increased hot gas path 104 temperatures.

For example, in some exemplary embodiments, one or more of a shroud block 106, a bucket 112, or a nozzle 114, such as one or more stages thereof, may be formed from a ceramic matrix composite ("CMC") material. For example, at least the portions of such components that are exposed in the hot gas path 104 may be formed from a CMC material, and/or other various portions or the entire components may be formed from a CMC material. It should be understood that a component or portion thereof formed from a CMC material may include other materials that are covered with a layer of CMC material, or may be formed solely from a CMC material. CMC materials are designed to withstand relatively increased temperatures. CMC materials are typically formed from ceramic fibers embedded in a ceramic matrix. The fibers and/or matrix may be formed from carbon, silicon carbide, alumina, mullite, or any other suitable materials.

In other exemplary embodiments, as shown in FIG. 6, one or more of a shroud block 106, a bucket 112, or a nozzle 114, such as one or more stages thereof, may define one or more cooling passages 130. The cooling passages 130 may be defined in any suitable orientation within the shroud blocks 106 and/or within the buckets 112 and/or nozzles 114. For example, the cooling passages 130 shown in FIG. 6 are generally serpentine cooling passages 130, but may have any other suitable configuration for cooling the shroud blocks 106, buckets 112, and/or nozzles 114. The cooling passages 130 may extend through at least the portion of the shroud blocks 106, buckets 112, and/or nozzles 114 that are exposed in the hot gas path 104, and may further extend through other portions of the shroud blocks 106, buckets 112, and/or nozzles 114.

The cooling passages 130 according to the present disclosure are in fluid communication with a steam source for flowing steam through the cooling passages 130. The steam source may be any suitable apparatus that may produce steam or communicate steam to the cooling passages 130. For example, in some embodiments, the steam source is a heat recovery steam generator 20. The heat recovery steam generator 20 may convert exhaust fluids from the system 10 into steam. At least a portion of this steam may be flowed to the turbine section 16 and to the cooling passages 130 of the shroud 102, plurality of buckets 112, and/or plurality of nozzles 114 therein. The flow of steam through the cooling passages 130 of such components may cool the components during operation of the system 10.

It should further be understood that CMC materials and/or cooling passages 130 for steam cooling may utilized in shroud blocks 106, buckets 112, or nozzles 114, such as any one or more stages thereof. For example, in some embodiments, CMC materials may be utilized for various shroud blocks 106, buckets 112, and/or nozzles 114 in a stage, while cooling passages 130 are utilized for various shroud blocks 106, buckets 112, or nozzles 114 in that stage or another stage.

The present disclosure thus advantageously provides a turbine system 10 that allows the various components of the turbine section 16 to withstand the increased temperatures that result from the use of a transition duct 50 in the combustor section 14.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A turbine system, comprising:

a transition duct having an inlet, an outlet, and a passage extending between the inlet and the outlet and defining a longitudinal axis, a radial axis, and a tangential axis, the outlet of the transition duct offset from the inlet along the longitudinal axis and the tangential axis; and a turbine section connected to the transition duct, the turbine section comprising a plurality of shroud blocks at least partially defining a hot gas path, a plurality of buckets at least partially disposed in the hot gas path, and a plurality of nozzles at least partially disposed in the hot gas path, wherein at least one shroud block is formed from one ceramic matrix composite, and wherein a passage with one inlet and one outlet is defined in the at least one shroud block, wherein the passage makes a plurality of passes in the at least one shroud block along a width or length of the at least one shroud block, and wherein steam flows through the passage.

2. The turbine system of claim 1, Wherein the outlet of the transition duct is further offset from the inlet along the radial axis.

3. The turbine system of claim 1, wherein at least one of a stage of shroud blocks, a stage of buckets, or a stage of nozzles is formed from a ceramic matrix composite.

4. The turbine system of claim 1, further comprising a plurality of transition ducts, each of the plurality of transition ducts disposed annularly about the longitudinal axis and connected to the turbine section.

5. The turbine system of claim 1, wherein the plurality of buckets includes a first stage bucket assembly and a second stage bucket assembly, each of the first stage bucket assembly and second stage bucket assembly comprising a plurality of buckets disposed in a generally annular array.

6. The turbine system of claim 5, wherein the plurality of nozzles includes a second stage nozzle assembly comprising a plurality of nozzles disposed in a generally annular array and positioned between the first stage bucket assembly and second stage bucket assembly.

7. The turbine system of claim 5, wherein no nozzles are disposed upstream of the first stage bucket assembly.

8. The turbine system of claim 1, wherein the transition duct extends from a fuel nozzle.

9. The turbine system of claim 1, wherein the transition duct extends from a combustor liner.

* * * * *